United States Patent [19]

Melconian

[11] 4,406,777

[45] Sep. 27, 1983

[54] FIXED BED REACTOR OPERATION

[75] Inventor: Melcon G. Melconian, Princeton, N.J.

[73] Assignee: Mobil Oil Corporation, N.Y.

[21] Appl. No.: 340,588

[22] Filed: Jan. 19, 1982

[51] Int. Cl.[3] ..... C10G 51/02

[52] U.S. Cl. ..... 208/156; 208/74; 208/190; 208/152

[58] Field of Search ..... 208/152, 156, 74, 49, 208/950; 422/190; 585/469

[56] References Cited

U.S. PATENT DOCUMENTS

| | | | |
|---|---|---|---|
| 1,867,841 | 7/1932 | Joseph | 208/74 |
| 2,031,600 | 2/1936 | Harrison et al. | 208/74 |
| 2,303,076 | 11/1942 | Frolich | 208/74 |
| 2,310,244 | 2/1943 | Lassiat | 208/146 |
| 2,362,795 | 11/1944 | Benedict | 208/74 |
| 2,425,555 | 8/1947 | Nelson | 208/156 X |
| 2,873,176 | 2/1959 | Hengstebeck | 422/190 |
| 2,875,148 | 2/1959 | Scofield | 208/74 |
| 2,924,632 | 2/1960 | Baumann | 422/190 X |
| 2,970,100 | 1/1961 | Moritz | 208/156 X |
| 3,128,242 | 4/1964 | Bergstrom et al. | 208/65 |
| 3,142,545 | 7/1964 | Raarup et al. | 422/190 X |
| 3,392,002 | 7/1968 | Hamilton et al. | 422/190 |
| 4,133,743 | 1/1979 | Boret et al. | 422/190 X |
| 4,259,294 | 3/1981 | Van Zijll Langhout et al. | 422/190 |

OTHER PUBLICATIONS

Levenspiel, "Chemical Reaction Engineering", John Wiley and Sons, 2nd Ed., 1972, p. 506.

*Primary Examiner*—Delbert E. Gantz
*Assistant Examiner*—Glenn A. Caldarola
*Attorney, Agent, or Firm*—Michael G. Gilman; Charles J. Speciale; Lowell G. Wise

[57] ABSTRACT

A catalytic conversion process wherein a slowly deactivating catalyst contained in a multiplicity of fixed bed is operated in a serial fashion whereby the operating temperature of each catalyst bed is higher than the preceeding bed and the last catalyst bed in the series is removed from operation when a predetermined operating temperature is reached, the catalyst in the removed bed is reactivated or replaced and the reactivated or fresh bed is returned to service as the first bed in the series of fixed catalyst beds.

10 Claims, 3 Drawing Figures

FIXED BED REACTOR OPERATION

BACKGROUND OF THE INVENTION

1. Field of the Invention

This invention relates to catalytically promoted chemical processes. More particularly, it relates to chemical processes conducted in the presence of a fixed bed of catalyst. This invention especially relates to a catalytic chemical process wherein the catalyst is provided in a multiplicity of fixed beds.

2. Description of the Prior Art

A myriad of chemical reactions are performed commercially each year in the chemical, petroleum, petrochemical and related industries. Many of these reactions are catalytically promoted by homogeneous or hetergeneous catalysts. The solid catalyzed fluid phase reactions are the most important and the most commonly encountered in today's industrial processes. Although for many years solid catalysts were employed in fixed beds, the development of gas oil cracking during World War II for the production of 100 octane aviation gasoline employed a solid catalyst in the form of a fluidized bed. Within a few years, the fluidized bed became the preferred means for conducting many industrial chemical processes. Despite the widespread use of fluidized catalyst beds, fixed beds of catalyst are still employed in a substantial number of chemical processes today.

In fixed bed processes, the activity of the catalyst in the bed usually declines with use, often because metallic materials in the feedstock or carbonaceous materials formed as a by-product in the reaction interfere with the effectiveness of the catalyst. It is usually necessary to periodically terminate the reaction in the catalyst bed and to either replace or regenerate the catalyst.

The variety of fixed catalyst beds which have been provided over the years has been limited only by the resourcefulness of the designer, the fabricator and the building contractor. In its simplest form a single fixed bed reactor is employed. The attendant deficiencies of this operation are manifest. Taking the catalyst bed off line often results in sub-standard products which must be discarded or re-processed. When the reactor is out of service while the catalyst is being replaced or regenerated, no product is being produced. Downtime is further extended during purging of the bed which is often necessary both before and after the regeneration. In addition, when the fixed bed is returned to service, the product produced during the initial on-stream period often fails to meet required quality standards.

Some of the problems encountered with single bed reactors have been alleviated through the use of a number of fixed bed reactors. U.S. Pat. No. 3,392,002 of Hamilton et al discloses a plurality of catalyst containing reactors which are interconnected so that they may be arranged in a series with any of the reactors occupying any position from first to last in the series. The reactors are also connected so that any of the reactors may be isolated from the series to permit regeneration of the catalyst therein. The complete flexibility provided in this system permits either parallel or series flow to be employed. The piping system here is an extremely complex system of manifolds involving numerous valves and crossovers. This operating flexibility is obtained at a very significant investment in valves and piping. U.S. Pat. No. 3,142,545 of Raarup et al addresses the investment problem when providing complete flexibility with multiple reactor systems by limiting the number of possible permutations and combinations through a simplified piping and valving arrangement. Although this system does not permit complete flexibility there is little sacrifice in operating efficiency. In a five reactor system, seventeen different flow arrangements are possible with this piping and valving. The flow through the reactors is series flow with parallel flow provided through two reactors in some particular arrangements. Each reactor can be segragated for regeneration.

U.S. Pat. No. 2,873,176 of Hengstebeck discloses a multiple reactor system where the processing of the feedstock is terminated and all of the reactors are regenerated. During the regeneration in Hengstebeck no product is produced. Following regeneration, the system is brought back onstream with the usual problems attendant during start up in a single reactor system.

Many multiple bed systems operate with complete parallel flow, e.g., U.S. Pat. Nos. 2,310,244 of Lassiat and 3,128,242 of Bergstrom et al., but most employ a serial flow pattern, e.g., U.S. Pat. Nos. 1,867,841; 2,873,176; 3,142,545; 3,392,002 and 4,259,294. Multiple bed reactor systems often employ the swing reactor concept wherein one reactor is removed from service for regeneration and a freshly regenerated reactor is simultaneously returned to service. In U.S. Pat. Nos. 1,867,841 of Joseph and 4,259,294 of Van Zijll Langhout et al. the spent reactor removed is the first reactor in the series and the reactor being returned to service is brought onstream as the last in the series. U.S. Pat. No. 3,142,545 of Raarup et al. teaches the use of a swing reactor in a reforming process. Since the catalyst in the several beds does not age uniformly because of the number of competing reactions taking place, it is not always the first or the last in the series which contains the most deactivated catalyst. The swing reactor is therefore brought onstream as a replacement for whichever of the several reactors requires regeneration. Although the first reactor in the series is always the one removed for regeneration in the multi-reactor process taught in U.S. Pat. No. 3,392,002 of Hamilton et al, the swing reactor is brought onstream as the second in line because of the particular operating sequence employed. In all four of these patents, however, the swing reactor is held in reserve after it has been regenerated and is returned to service only when one of the other reactors requires regeneration. There is no suggestion in the prior art of placing an out-of-service reactor back onstream as soon as the deactivated catalyst has been regenerated or replaced.

It is an object of this invention to provide a process for catalytic conversion with a slowly deactivating catalyst.

It is another object of this invention to provide a catalytic conversion process with a slowly deactivating catalyst wherein the equipment investment is minimized.

It is a further object of this invention to provide a process of catalytic conversion with a slowly deactivating catalyst in a series of fixed bed reactors wherein the offstream time for each reactor is minimized.

It is yet another object of this invention to provide a process of catalytic conversion with a slowly deactivating catalyst in a series of fixed bed reactors at a minimum capital investment.

These and other objects will be achieved by practicing the invention disclosed hereinafter.

SUMMARY OF THE INVENTION

In accordance with the present invention a catalytic conversion process is provided with a slowly deactivating catalyst in a multiplicity of fixed beds operated in a serial fashion whereby the operating temperature in each bed is higher than the preceding bed and the last bed in the series is removed from operation when a predetermined temperature is reached, the catalyst in the last bed is reactivated or replaced and the reactivated or fresh bed is returned to service as the first bed in the series.

In particular, this invention relates to an improvement in a catalytic chemical conversion process of the type wherein a reaction mixture is brought into contact with a quantity of catalyst under reaction conditions effective to obtain a predetermined conversion of said reaction mixture, wherein said catalyst is (a) gradually deactivated during the period of reaction (b) removed from service when deactivated to a predetermined level, (c) regenerated or replaced and (d) promptly returned to service, wherein the reaction temperature of the reaction mixture is increased to maintain the predetermined conversion during the reaction period from an initial reaction temperature to a final reaction temperature above which either the catalyst activity is below the predetermined level or the predetermined conversion cannot be obtained, said improvement comprising:

(a) providing the quantity of catalyst in equal amounts in a multiplicity of fixed beds, said multiplicity being n, a whole integer, (b) passing the reaction mixture under said reaction conditions serially through said multiplicity of said fixed beds, the initial temperature of said first of said fixed beds being said initial reaction temperature and the initial temperature of each succeeding fixed bed being substantially equal to the reaction temperature at the end of a fractional part of the reaction period when the same reaction mixture is converted at the said predetermined conversion in a single fixed bed containing said quantity of said catalyst, said fractional part being $$\frac{\text{(the number of said fixed bed in the series)} - 1}{n},$$

(c) adjusting the temperature of the effluent from each fixed bed, except the nth bed, to provide the reaction temperature required in the next succeeding fixed bed, (d) increasing the reaction temperature in each of said fixed beds to maintain the predetermined conversion until the reaction temperature in the nth fixed bed is substantially equal to said final reaction temperature, (e) removing said nth fixed bed from service while continuing to pass the reaction mixture through the remaining fixed bed(s), (f) regenerating or replacing the catalyst in said nth fixed bed, and (g) returning said nth fixed bed to service by passing the reaction mixture through said nth fixed bed as the first bed in the series of fixed beds and the (n−1)th fixed bed as the last bed in said series.

DESCRIPTION OF THE PREFERRED EMBODIMENTS

Figure 1:
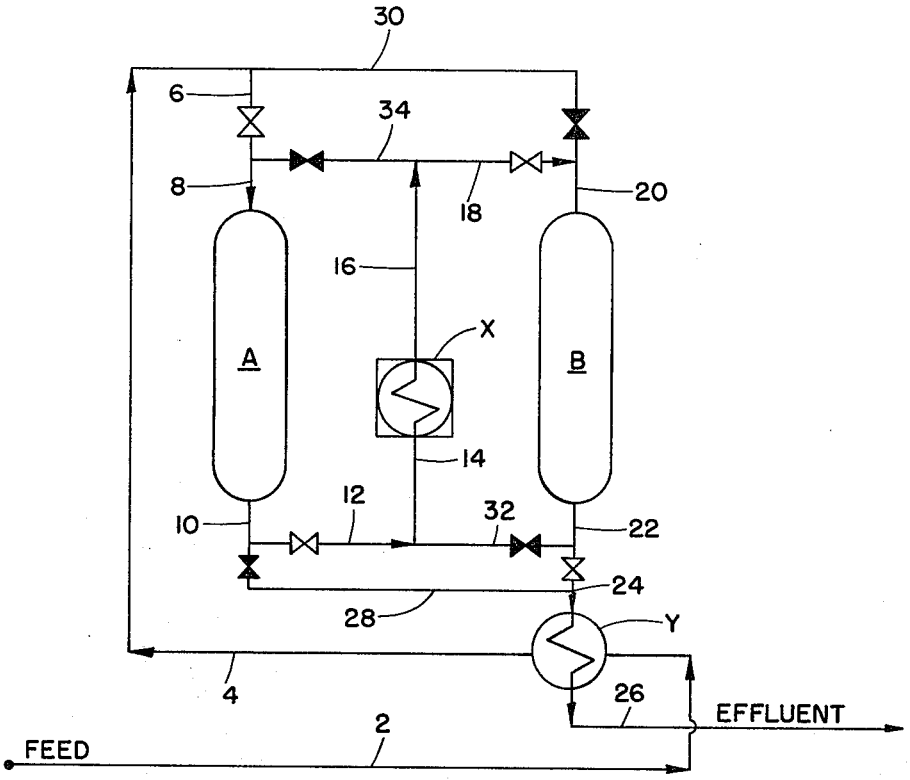
FIG. 1 is a schematic flowplan of an embodiment of the invention.

The present invention relates to a multiple reactor system operated in a serial fashion. Each reactor contains a fixed bed of catalyst which deactivates over the period of use. Although the activity can be maintained by increasing the reaction temperature, a point is reached where the temperature cannot be increased any further because of temperature limitations in the equipment or because further temperature increases will not maintain the desired activity. At this point, the catalyst is either replaced or regenerated to return the catalyst to substantially its original activity level.

In accordance with the present invention, each reactor in the series contains a catalyst bed whose activity is somewhat less than that of the preceeding catalyst bed so that the reaction temperature in the series of reactors increases as the reaction mixture passes serially from the first to the last reactor. As the reaction temperature in the last reactor reaches the usual end-of-the cycle level, this reactor is removed from service and the conversion is continued temporarily with the remaining reactor or reactors. The catalyst in the off-cycle reactor is either replaced or regenerated and the reactivated reactor is then promptly returned to service as the first reactor is the series. During the time that this reactor is off-line, the reaction conditions in the remaining reactors are either maintained as before with some reduction in conversion or adjusted to provide a product of the same quality. The process is continued in this fashion, with the last reactor in line removed from service as the catalyst becomes deactivated to be later returned to service as the first reactor in the series. Each reactor thereby passes through a temperature cycle, beginning at the lowest temperature required for a fresh or regenerated caatalyst to provide the required conversion fraction and continuing to the highest temperature at the end of the catalyst cycle.

By operating in this fashion vis-a-vis a single reactor operating in blocked-out operations or a fixed bed system operating with a spare or swing reactor, increased onstream time, increased production, reduced catalyst inventory and reduced investment in equipment are obtained.

This invention may be practiced with a variety of catalytically promoted chemical conversions, particularly those employing a fixed bed of heterogeneous catalyst which gradually becomes deactivated in use and which must eventually be replaced or regenerated. Processes of this type include many commercially practical processes in the petroleum, chemical and petrochemical industries. Such catalytic processes include the conversion of methanol to olefins and/or gasoline, petroleum cracking and isomerization as well as such hydroconversion processes as hydrotreating, hydrodewaxing and hydrocracking.

In practicing this invention, each catalyst bed passes through substantially the same cycle as does a single catalyst bed functioning in an on-off cycle. Thus the fresh catalyst bed initially receives the fresh feed until the catalyst becomes somewhat deactivated. At this point, it becomes second in line and is operated at a somewhat higher temperature while processing a feed which has been partially converted in the first reactor. Depending on the number of reactors in the particular system, this procedure will continue until the particular catalyst bed is the last in line producing as effluent at a predetermined conversion with the operating temperature being that utilized at the end of on-stream period for the single catalyst bed system.

In accordance with the present invention, the catalyst is provided in equal quantities in a multiplicity of fixed beds. The number of fixed beds employed in a particular conversion will require an evaluation by the skilled artisan, taking into consideration a variety of factors and variables including, for example, the nature and type of reaction, the nature of the catalyst, the deactivation rate of the catalyst insofar as it influences the catalyst onstream time, the time required for catalyst regeneration or replacement, and the investment cost of equipment as it is influenced by the number of reactors and the complexity of valves and piping. In most instances, the number of reactors which will be usefully employed will be between 2 and 6, preferably between 2 and 4, but more reactors may be found useful in particular situations.

During the reaction period, the reaction mixture is passed through the multiplicity of reactors in serial flow with the freshest catalyst being located in the initial reactor and the catalyst in each succeeding reactor having increasingly less activity. The operating temperature is therefore increased in each succeeding reactor to maintain catalyst activity. The initial reaction temperature in each reactor is substantially equal to the reaction temperature at the end of a fractional part of the reaction period when the same reaction mixture is converted at the same predetermined conversion in a single fixed bed reactor containing the total quantity of catalyst present in the multiplicity of reactors. The initial temperature of a particular reactor is dependent on its position in the series of reactors. Thus, where the number of reactors employed in n, the fractional part of the reaction period, from which the temperature is obtained by reference to the performance of a single bed reactor, is $$\frac{\text{(the number of the fixed bed of interest in the series of reactors)} - 1}{n\text{, the total number of reactors}}$$

Assuming a four reactor system, the third reactor in the series will have an initial temperature at the end of $(3-1/4)$ or 0.5 of the reaction period of the single fixed bed reactor described above. The temperature will be gradually increased in this third reactor until it becomes the fourth reactor in the series with an initial operating temperature substantially equal to that at the end of $(4-1/4)$ or 0.75 of the reaction period of the single fixed bed reactor standard.

Those skilled in the art will appreciate that depending on whether the particular reaction is exothermic or endothermic, the effluent from a reactor may not be at an appropriate temperature for continuance of the desired conversion in the next reactor in the series. Therefore it is usually necessary to provide a heat exchange means between each reactor to remove or add heat to each effluent stream before it enters the next reactor. The quantity of heat to be added or removed will be dictated by a number of variables and conditions, such as, for example, the temperature limitation of the equipment and/or the particular catalyst, the conversion and/or product quality desired and the position of the particular reactor in the reactor series.

Another factor to be considered is the length of the off-stream time required to return the catalyst bed to the required activity level. Catalyst replacement may require a significant period of time although it will normally be dependent on the configuration and design of the reactor since in most instances the nature of the catalyst will not significantly influence the replacement time. The length of the on-stream period will not usually affect the replacement time but may be a significant factor where the catalyst is to be regenerated in situ. The time required for catalyst regeneration will often be directly proportional to the onstream time since the nature and quality of the coke on the catalyst is usually dependent on the length of time the catalyst has been in service. During replacement or regeneration of the catalyst in an off-stream reactor, the remaining reactors will continue in service processing the feed and producing required products with the temperature in these reactors being increased as required to maintain the desired catalyst activity in each reactor.

In its simplest embodiment, this invention is practiced with two fixed bed reactors as illustrated in FIG. 1. Referring to this figure, reactors A and B each contain a fixed bed of a regenerable catalyst. Other major pieces of processing equipment include heat exchanger Y and cooler X, where the conversion is exothermic, or heater X, where the conversion is endothermic (for simplicity, reference will be made hereafter to cooler X). In addition, piping and valves are provided to permit the processing of the feed in the following sequences:

Stage 1—Reactor A, Cooler X, Reactor B
Stage 2—Reactor A alone (Regeneration of Reactor B)
Stage 3—Reactor B, Cooler X, Reactor A
Stage 4—Reactor B alone (Regeneration of Reactor A)

In Stage 1, for example, the feed passes through line 2 into heat exchanger Y where it is preheated by the effluent stream leaving the process. The preheated feed than passes through lines 4, 6 and 8 into reactor A which contains fresh catalyst. The operating temperature here is lower than that in reactor B. The feed is partially converted in the catalyst bed of reactor A with the release of heat. The reaction mixture passes from reactor A through lines 10, 12 and 14 to cooler X where some of the exothermic heat is removed and the temperature of the mixture is adjusted to provide the necessary operating temperature for the partially deactivated bed of catalyst in reactor B. The mixture passes from cooler X through lines 16, 18 and 20 into reactor B where the final conversion of the reaction mixture takes place. The effluent passes from reactor B through lines 22 and 24 to heat exchanger Y where the effluent provides the preheat for the incoming feed. The cooled effluent passes from the process unit through line 26 to off-site product storage.

Where the catalyst bed in reactor B is deactivated to the point of requiring regeneration, the process enters stage 2. Reactor B is taken off stream and the catalyst bed is regenerated, for example, by a circulating stream of oxidative gas (not shown) by procedures well known in the catalyst art. During this time, the feed is being processed by reactor A only. The process flow is as follows: line 2, heat exchanger Y, lines 4, 6 and 8, reactor B, lines 10, 28 and 24, heat exchanger Y and line 26. Where the reaction conditions, such as space velocity and operating temperature, are maintained, there will be some change in product quality since the conversion will be reduced. Where this is undesirable, conversion can be maintained during the regeneration of reactor B by adjusting the operating conditions, such as space velocity.

When reactor B is regenerated it is returned to serve as the initial reactor in the series and is therefore operated at a lower temperature than reactor A. This is stage 3 where the flow is as follows: line 2, heat exchanger Y, lines 4, 30 and 20, reactor B, lines 22, 32 and 14, cooler X, lines 16, 34 and 8, reactor A, lines 10, 28 and 24, heat exchanger Y and line 26.

When reactor A reaches the end of its operating cycle it is taken off stream and regenerated in the same fashion as reactor B. This is stage 4. As was the situation in stage 2, a single reactor is onstream and the operating conditions are established to maintain feed rate or product quality. The flow here is as follows: line 2, heat exchanger Y, lines 4, 30 and 20, reactor B, lines 22 and 24, heat exchanger Y and line 26.

When reactor A is regenerated the entire cycle is completed and a new cycle is commenced starting as above with stage 1.

Processing units containing 3, 4 or more reactors can be operated in similar fashion.

Figure 2:
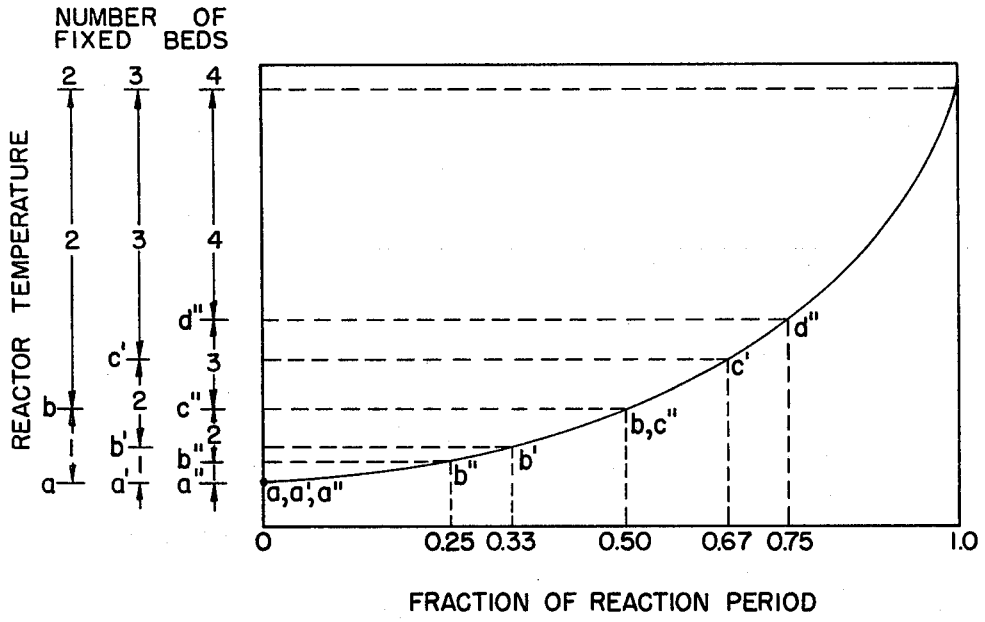
FIG. 2 is a graph showing the reaction temperature in a number of multiple bed reactors operated in accordance with the present invention wherein the catalyst slowly loses its initial activity during the reaction period.
Figure 3:
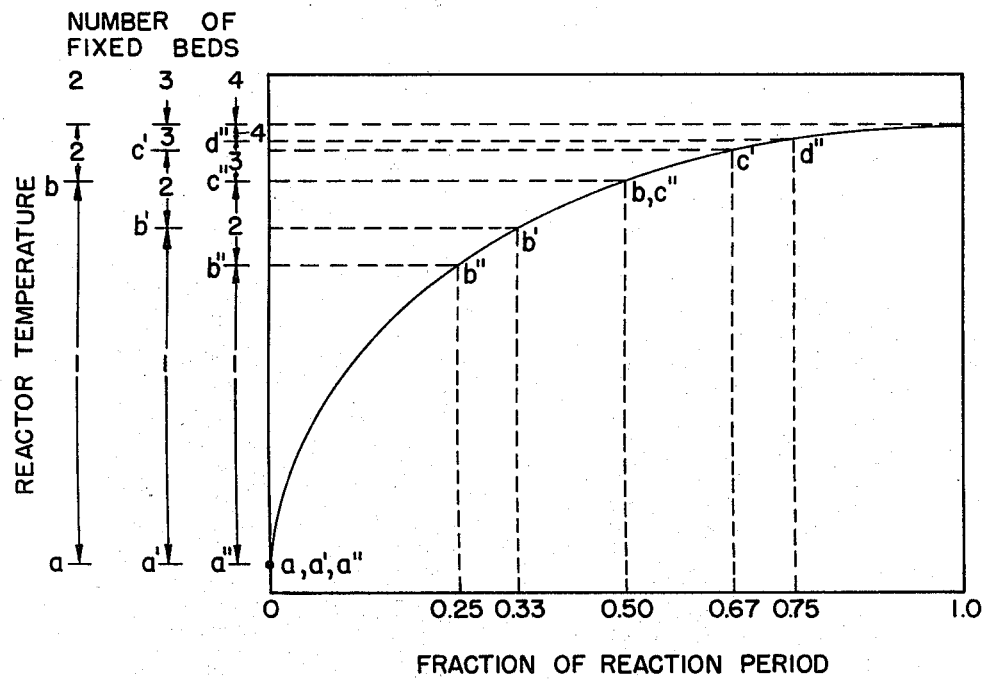
FIG. 3 is a graph showing the reaction temperature in a number of multiple bed reactors operated in accordance with the present invention wherein the catalyst rapidly loses its initial activity during the reaction period.

Referring to FIGS. 2 and 3, the reactor temperatures during a cycle are presented for several embodiments of the invention, FIG. 2 is a typical of a catalyst where the deactivation is initially very slight but increases more rapidly near the end of the cycle. FIG. 3, on the other hand, illustrates a catalyst where the deactivation is initially quite rapid but slows down near the end of the cycle. The reaction temperature illustrated is that required to maintain a predetermined conversion. Each figure shows the temperature for each reactor in a series of 2, 3 or 4 reactors. Thus, the temperature for each reactor in a four reactor system is identified on the curve as follows:

reactor 1—a″ to b″
reactor 2—b″ to c″
reactor 3—c″ to d″
reactor 4—d″ to end.

What is claimed is:

1. In a catalytic chemical conversion process of the type wherein a reaction mixture is brought into contact with a quantity of catalyst under reaction conditions effective to obtain a predetermined conversion of said reaction mixture, wherein said catalyst is (a) gradually deactivated during the period of reaction, (b) removed from service when deactivated to a predetermined level, (c) regenerated or replaced and (d) returned to service, wherein the reaction temperature of the reaction mixture is increased to maintain the predetermined conversion during the reaction period from an initial reaction temperature to a final reaction temperature above which either the catalyst activity is below the predetermined level or the predetermined conversion cannot be obtained, the improvement which comprises:

(a) providing the quantity of catalyst in equal amounts in a multiplicity of fixed beds, said multiplicity being n, a whole integer, (b) passing the reaction mixture under said reaction conditions serially through said multiplicity of said fixed beds, the initial temperature of said first of said fixed beds being said initial reaction temperature and the initial temperature of each succeeding fixed bed being substantially equal to the reaction temperature at the end of a fractional part of the total reaction period when the same reaction mixture is converted at the said predetermined conversion in a single fixed bed containing said quantity of said catalyst, said fractional part being $$\frac{(\text{the number of said fixed bed in the series}) - 1}{n},$$

(c) adjusting the temperature of the effluent from each fixed bed, except the nth bed, to provide the reaction temperature required in the next succeeding fixed bed, (d) increasing the reaction temperature in each of said fixed beds to maintain the predetermined conversion until the reaction temperature in the nth fixed bed is substantially equal to said final reaction temperature, (e) removing said nth fixed bed from service while continuing to pass the reaction mixture through the remaining fixed bed(s), (f) regenerating or replacing the catalyst to reactivate said nth fixed bed, and (g) returning said nth fixed bed to service by passing the reaction mixture through said reactivated fixed bed as the first bed in the series of fixed beds and the (n−1)th fixed bed as the last bed in said series.

2. A process according to claim 1 where, during the period when said nth fixed bed is out of service, the reaction mixture is passed through the remaining fixed beds in step (d) under reaction conditions to maintain substantially the same product quality as was obtained in steps (b) and (c).

3. A process according to claim 1 where, during the period when said nth fixed bed is out of service, the reaction mixture is passed through the remaining fixed beds in step (d) under substantially the same reaction conditions employed in steps (b) and (c) with reduction in conversion, and wherein exothermic heat is removed by cooling the reaction mixture following said first bed.

4. A process according to claim 1 wherein n is from 2 to 6.

5. A process according to claim 4 wherein n is 2.

6. A process according to claim 4 wherein n is 3.

7. A process according to claim 4 wherein n is 4.

8. A process according to claim 1 wherein the chemical conversion is the conversion of methanol to gasoline boiling range hydrocarbons.

9. A continuous exothermic catalytic conversion process with slowly deactivating catalyst wherein multiple fixed bed reactors are connected serially with operating temperatures in each bed being higher than the preceding bed, whereby the last serial bed is operated at the highest process temperature and contains more deactivated catalyst than the preceding bed, an improved reactivation sequence comprising the steps of operating all fixed bed reactors in serial operation with each succeeding catalyst bed having activity less than the preceding catalyst until the last bed becomes deactivated to require predetermined maximum temperature from catalytic conversion;

discontinuing the conversion process in the last bed while temporarily maintaining the continuous conversion process in the remaining preceding beds in the serial sequence with increased temperature in each of the remaining beds to maintain the desired catalyst activity;

reactivating the discontinued catalyst bed; and returning the reactivated bed promptly to service in the continuous process as the first serial bed at lowest process reactor temperature.

10. In a continuous catalytic conversion according to claim 9, the further improvement which comprises providing the process catalyst inventory in substantially equal quantities in each of the fixed beds in the multiple reactor series.

* * * * *